US010596820B2

(12) United States Patent
Abe et al.

(10) Patent No.: US 10,596,820 B2
(45) Date of Patent: Mar. 24, 2020

(54) INKJET PRINTING APPARATUS AND TANK

(71) Applicant: CANON KABUSHIKI KAISHA, Tokyo (JP)

(72) Inventors: Takashi Abe, Kawasaki (JP); Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/275,460

(22) Filed: Feb. 14, 2019

(65) Prior Publication Data

US 2019/0263135 A1 Aug. 29, 2019

(30) Foreign Application Priority Data

Feb. 23, 2018 (JP) ..... 2018-030844

(51) Int. Cl.

| | |
|---|---|
| ***B41J 2/175*** | (2006.01) |
| ***B41J 2/18*** | (2006.01) |
| ***B41J 29/38*** | (2006.01) |
| ***B41J 2/19*** | (2006.01) |
| ***B41J 11/00*** | (2006.01) |

(52) U.S. Cl.

CPC ..... *B41J 2/17566* (2013.01); *B41J 2/175* (2013.01); *B41J 2/17513* (2013.01); *B41J 2/18* (2013.01); *B41J 2/19* (2013.01); *B41J 11/00* (2013.01); *B41J 29/38* (2013.01); *B41J 2002/17576* (2013.01); *B41J 2002/17579* (2013.01)

(58) Field of Classification Search

CPC ..... B41J 2/17566; B41J 11/00; B41J 2/175; B41J 2/19; B41J 2/17513; B41J 29/38; B41J 2/18; B41J 2002/17579; B41J 2002/17576

See application file for complete search history.

(56) References Cited

U.S. PATENT DOCUMENTS 6,470,744 B1 * 10/2002 Usui ..... B41J 2/17503 73/290 R
7,070,264 B2 7/2006 Ikeda

FOREIGN PATENT DOCUMENTS

| | | | |
|---|---|---|---|
| JP | H08-216422 | A | 8/1996 |
| JP | 2004-174793 | A | 6/2004 |
| JP | 2004-188933 | A | 7/2004 |
| JP | 2005-074729 | A | 3/2005 |

OTHER PUBLICATIONS

IP.com search (Year: 2019).*

* cited by examiner

*Primary Examiner* — Lisa Solomon
(74) *Attorney, Agent, or Firm* — Venable LLP

(57) ABSTRACT

Provided is an inkjet printing apparatus comprising: a print head that ejects ink; a tank that contains ink to be supplied to the print head; a floating body that floats on the liquid surface of the ink inside the tank; and an electrode pin that detects the level of the liquid surface inside the tank. The floating body includes an opening portion in which to insert the electrode pin, and a perimeter of the opening portion protrudes from a top surface side of the floating body.

20 Claims, 12 Drawing Sheets

INKJET PRINTING APPARATUS AND TANK

BACKGROUND OF THE INVENTION

Field of the Invention

The present invention relates to an inkjet printing apparatus and a tank.

Description of the Related Art

Inkjet printing apparatuses perform printing by ejecting ink from the surface of a print head where ejection openings are provided. Here, in a case where the ink contains bubbles, clogging of ejection openings with the bubbles or the like state may occur and lower the ejection performance. To address this, gases dissolved in the ink are removed.

Japanese Patent Application Laid-Open No. 2004-174793 (hereinafter, Document 1) discloses an apparatus that removes gases dissolved in ink, and a blocker that floats on the liquid surface of ink inside an ink storage to block contact between the ink and air.

In the case where ink stored in a tank is deaerated, gases dissolved in the ink inside the tank appear in the form of bubbles and rise. With the technique of Document 1, the bubbles come into contact with and stagnate on the bottom surface of the blocker. In this case, the stagnation of bubbles increases the area of contact between the ink and air and thus increases the likelihood of re-dissolution of gases into the ink inside the tank.

SUMMARY OF THE INVENTION

An inkjet printing apparatus according to an aspect of the present invention comprises: a print head that ejects ink; a tank that contains ink to be supplied to the print head; a floating body that floats on a liquid surface of the ink inside the tank; and an electrode pin that detects a level of the liquid surface inside the tank. The floating body includes an opening portion in which to insert the electrode pin, and a perimeter of the opening portion protrudes from a top surface side of the floating body.

Further features of the present invention will become apparent from the following description of exemplary embodiments with reference to the attached drawings.

DESCRIPTION OF THE EMBODIMENTS

Figure 1:
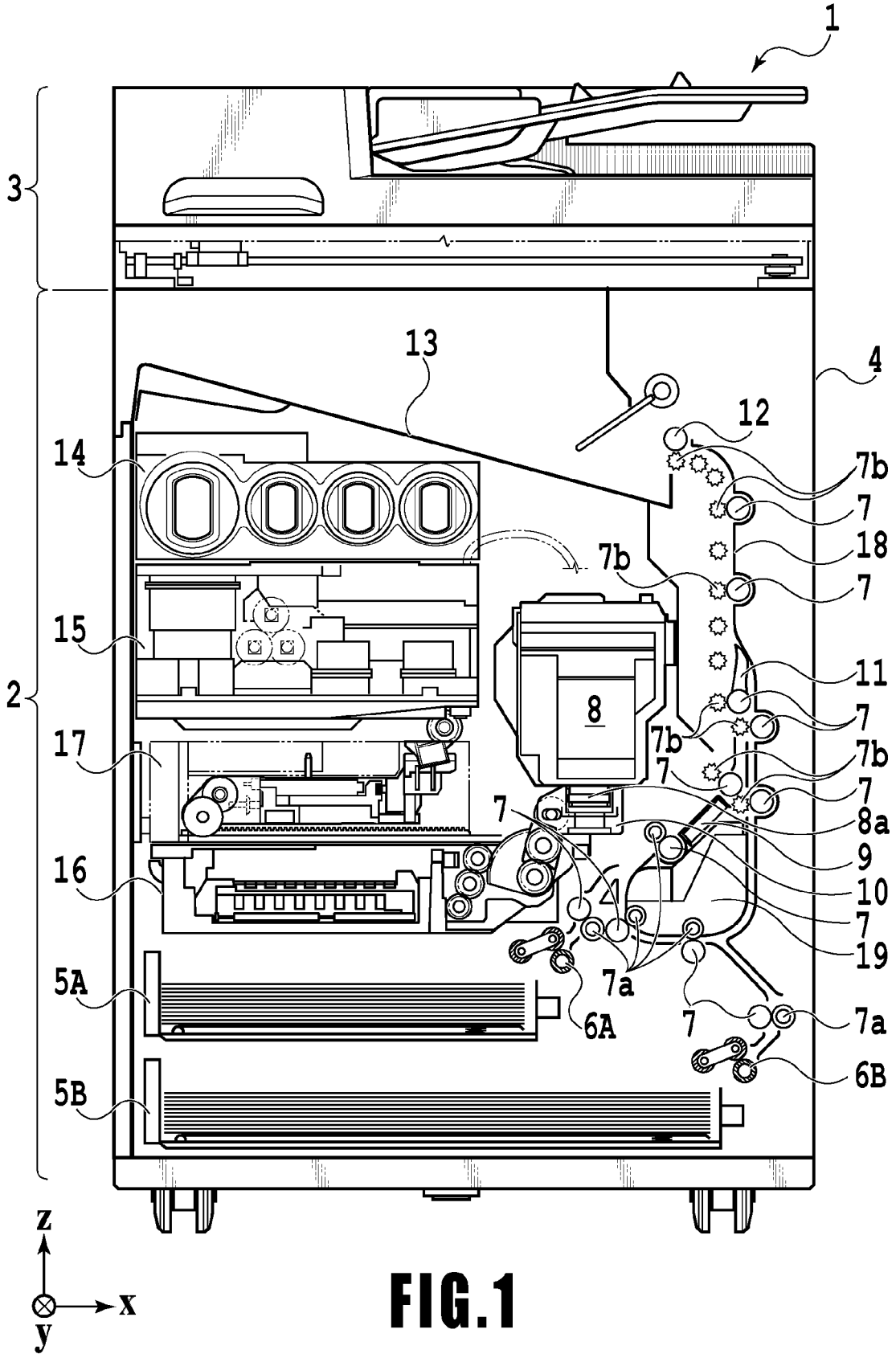
FIG. 1 is a diagram showing a printing apparatus in a standby state.

Embodiments of the present invention will be described below with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following descriptions. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8.

Figure 2:
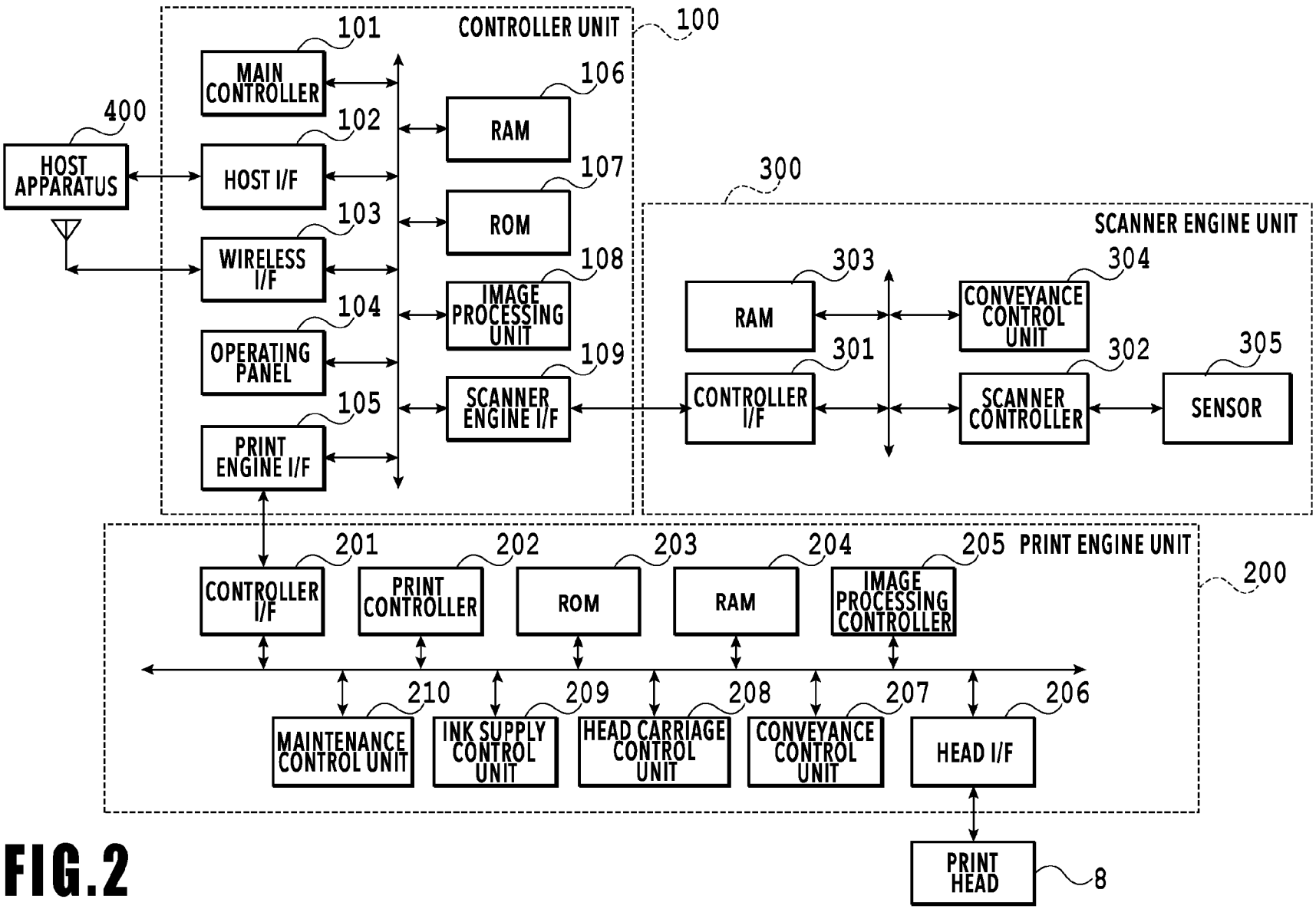
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, in a case where a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, if a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

Ahead carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 at the time of performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
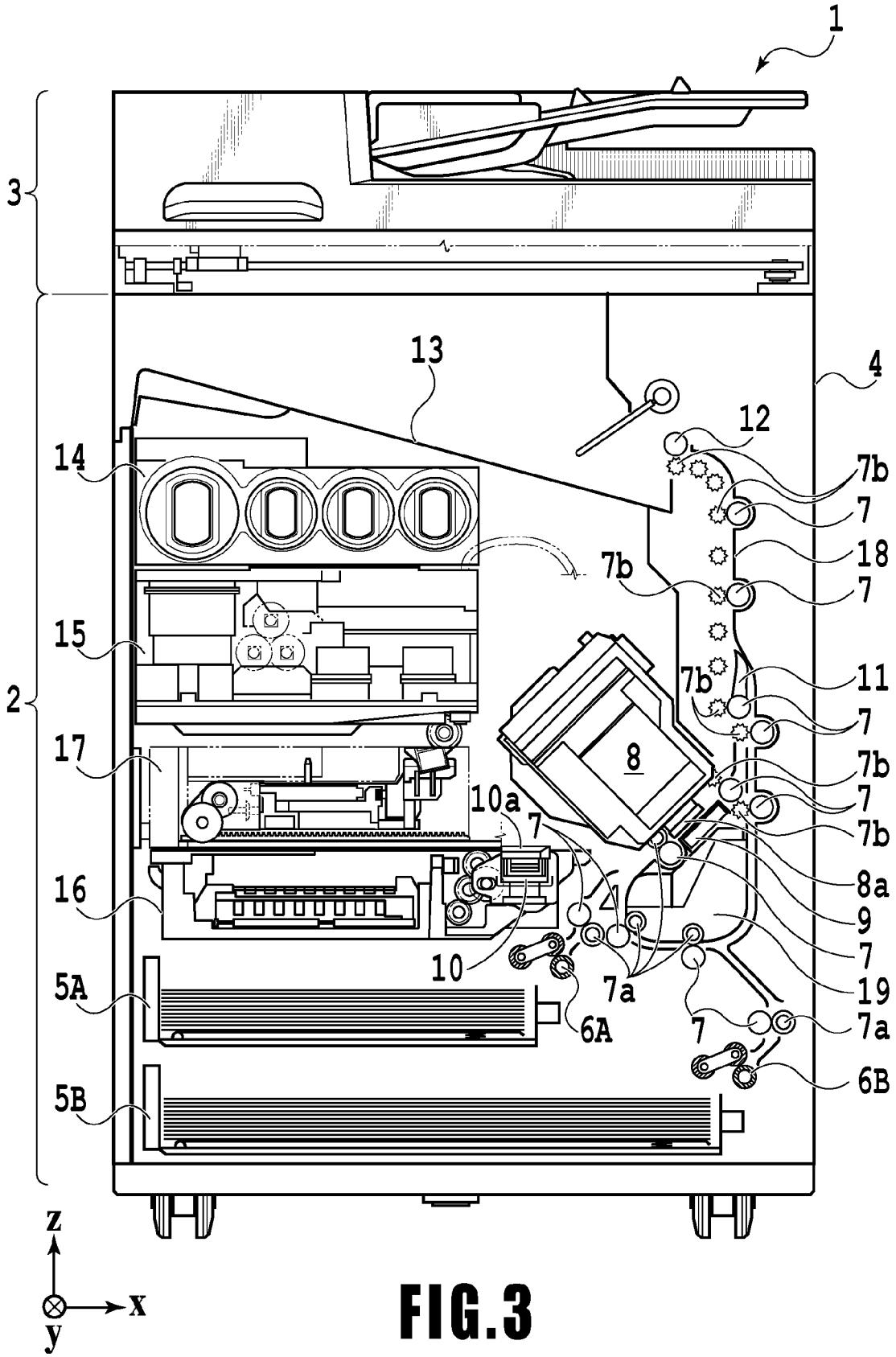
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Figure 4:
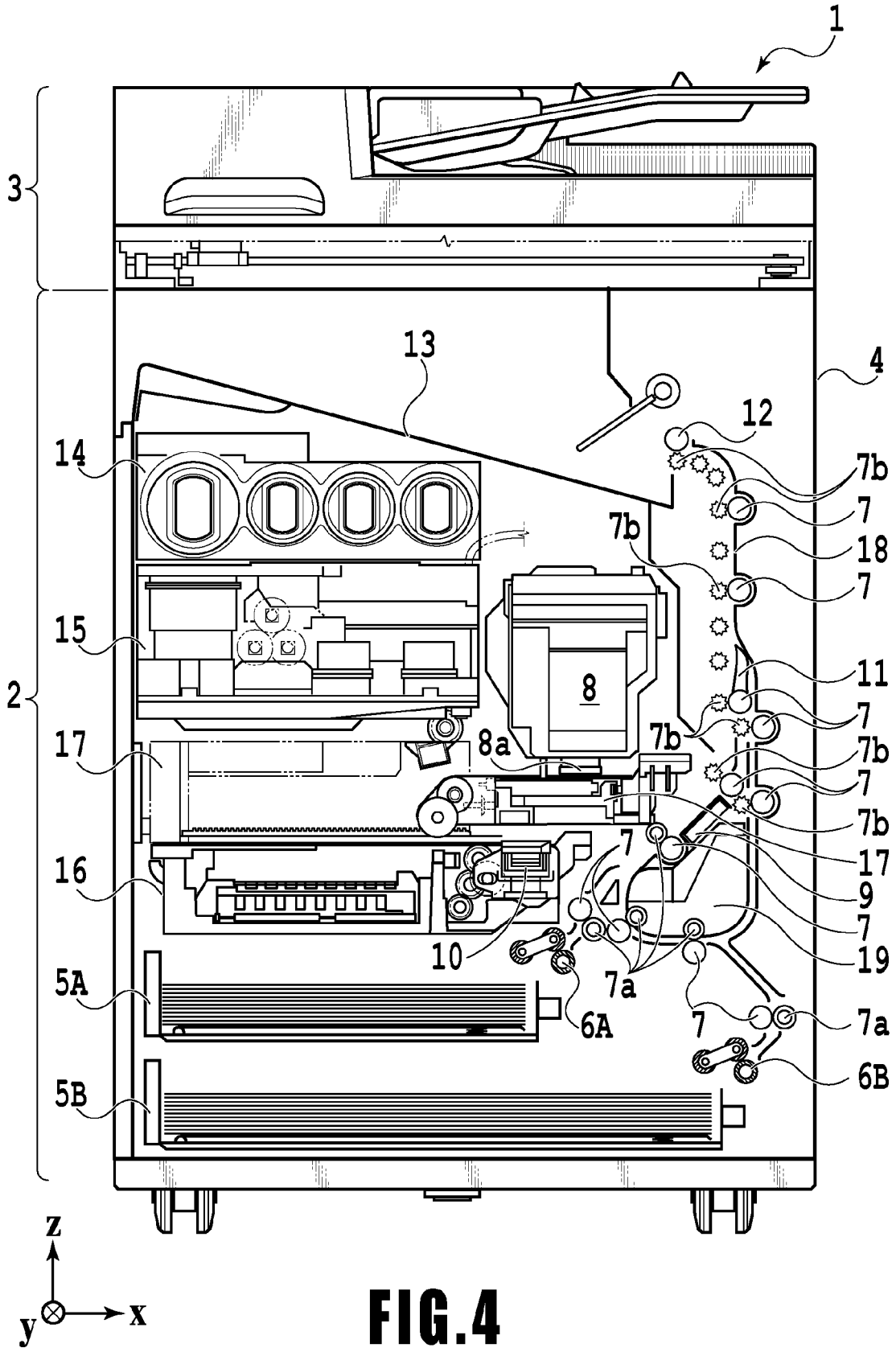
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

(Ink Supply Unit (Ink Circulation System))

Figure 5:
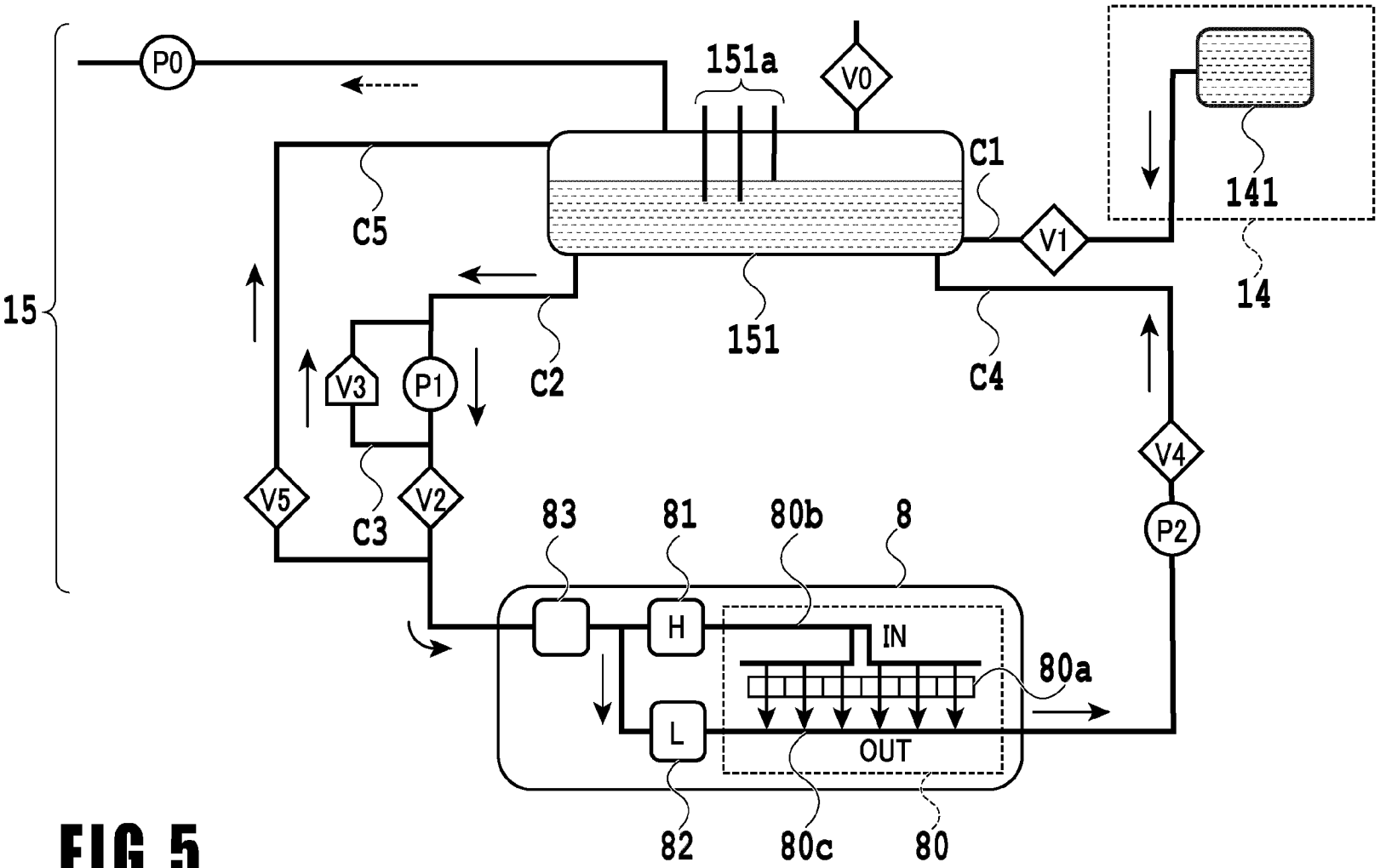
FIG. 5 is a diagram illustrating a flow path configuration of an ink circulation system.

FIG. 5 is a diagram including the ink supply unit 15 adopted in the printing apparatus 1 of the present embodiment. With reference of FIG. 5, a flow path configuration of an ink circulation system of the present embodiment will be described. The ink supply unit 15 is a configuration of supplying ink from the ink tank unit 14 to the print head 8 (also refereed as head unit in FIG. 5 and the subsequent FIGS.). In the diagram, a configuration of one color ink is shown, but such a configuration is practically prepared for each color ink. The ink supply unit 15 is basically controlled by the ink supply control unit 209 shown in FIG. 2. Each configuration of the unit will be described below.

Ink is circulated mainly between a sub-tank 151 and the head unit. In the head unit 8, ink ejection operation is performed based on image data and ink that has not been ejected is collected and flows back to the sub-tank 151.

The sub-tank 151 in which a certain amount of ink is contained is connected to a supply flow path C2 for supplying ink to the head unit 8 and to a collection flow path C4 for collecting ink from the head unit 8. In other words, a circulation path for circulating ink is composed of the sub-tank 151, the supply flow path C2, the head unit 8, and the collection flow path C4.

In the sub-tank 151, electrode pins 151*a* composed of a plurality of pins is provided. The ink supply control unit 209 detects presence/absence of a conducting current between those pins so as to grasp a height of an ink liquid level, that is, an amount of remaining ink inside the sub-tank 151. A vacuum pump P0 (intra-tank vacuum pump) is a negative pressure generating source for reducing pressure inside the sub-tank 151. An atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is made of a flexible member, and the volume change of the flexible member allows filling the sub-tank 151 with ink. The main tank 141 has a configuration removable from the printing apparatus body. In the midstream of a tank connection flow path C1 connecting the sub-tank 151 and the main tank 141, a tank supply valve V1 for switching connection between the sub-tank 151 and the main tank 141 is provided.

Under the above configuration, once the electrode pins 151*a* detect that ink inside the sub-tank 151 is less than the certain amount, the ink supply control unit 209 closes the atmosphere release valve V0, a supply valve V2, a collection valve V4, and a head replacement valve V5 and opens the tank supply valve V1. In this state, the ink supply control unit 209 causes the vacuum pump P0 to operate. Then, the inside of the sub-tank 151 is to have a negative pressure and ink is supplied from the main tank 141 to the sub-tank 151. Once the electrode pins 151*a* detect that the amount of ink inside the sub-tank 151 is more than the certain amount, the ink supply control unit 209 closes the tank supply valve V1 and stops the vacuum pump P0.

The supply flow path C2 is a flow path for supplying ink from the sub-tank 151 to the head unit 8, and a supply pump P1 and the supply valve V2 are arranged in the midstream of the supply flow path C2. During print operation, driving the supply pump P1 in the state of the supply valve V2 being open allows ink circulation in the circulation path while supplying ink to the head unit 8. The amount of ink to be ejected per unit time by the head unit 8 varies according to image data. A flow rate of the supply pump P1 is determined so as to be adaptable even in a case where the head unit 8 performs ejection operation in which ink consumption amount per unit time becomes maximum.

A relief flow path C3 is a flow path which is located in the upstream of the supply valve V2 and which connects between the upstream and downstream of the supply pump P1. The connection point at which the relief flow path C3 is connected to the upstream side of the supply pump P1 will be referred to as the first connection point, and the connection point at which the relief flow path C3 is connected to the downstream side of the supply pump P1 will be referred to as the second connection point. In the midstream of the relief flow path C3, a relief valve V3 which is a differential pressure valve is provided. In a case where an amount of ink supply from the supply pump P1 per unit time is larger than the total value of an ejection amount of the head unit 8 per unit time and a flow rate (ink drawing amount) in a collection pump P2 per unit time, the relief valve V3 is released according to a pressure applied to its own. As a result, a cyclic flow path composed of a portion of the supply flow path C2 and the relief flow path C3 is formed. By providing the configuration of the above relief flow path C3, the amount of ink supply to the head unit 8 is adjusted according to the ink consumption amount by the head unit 8 so as to stabilize a pressure inside the circulation path irrespective of image data.

The collection flow path C4 is a flow path for collecting ink from the head unit 8, back to the sub-tank 151. At the time of ink circulation within the circulation path, the collection pump P2 sucks ink from the head unit 8 by serving as a negative pressure generating source. By driving the collection pump P2, an appropriate differential pressure is generated between an IN flow path 80*b* and an OUT flow path 80*c* inside the head unit 8, thereby causing ink to circulate between the IN flow path 80*b* and the OUT flow path 80*c*. A flow path configuration inside the head unit 8 will be described later in detail.

The collection valve V4 is a valve for preventing a backflow at the time of not performing print operation, that is, at the time of not circulating ink within the circulation path. In the circulation path of the present embodiment, the sub-tank 151 is disposed higher than the head unit 8 in a vertical direction (see FIG. 1). For this reason, in a case where the supply pump P1 and the collection pump P2 are not driven, there may be a possibility that ink flows back from the sub-tank 151 to the head unit 8 due to a water head difference between the sub-tank 151 and the head unit 8. In order to prevent such a backflow, the present embodiment provides the collection valve V4 in the collection flow path C4.

Similarly, at the time of not performing print operation, that is, at the time of not circulating ink within the circulation path, the supply valve V2 also functions as a valve for preventing ink supply from the sub-tank 151 to the head unit 8.

A head replacement flow path C5 is a flow path connecting the supply flow path C2 and an air chamber (an upper space in which ink is not contained) of the sub-tank 151, and in its midstream, the head replacement valve V5 is provided. One end of the head replacement flow path C5 is connected to a point along the supply flow path C2 upstream of the head unit 8, and this connection point will be referred to as the third connection point. The third connection point is provided downstream of the supply valve V2. The other end of the head replacement flow path C5 is connected to an upper portion of the sub-tank 151 and thus communicates with the air chamber inside the sub-tank 151. This connection point will be referred to as the fourth connection point. The head replacement flow path C5 is used in the case of collecting ink from the head unit 8 in use such as upon replacing the head unit 8 or transporting the printing apparatus 1. The head replacement valve V5 is controlled by the ink supply control unit 209 so as to be closed except for a case of ink filling in the printing apparatus 1 and a case of collecting ink from the head unit 8. In addition, the above-described supply valve V2 is provided, in the supply flow path C2, between a third connection point to the head replacement flow path C5 and a second connection point to the relief flow path C3. Note that the second connection point may alternatively be provided at a point along the supply flow path C2 downstream of the third connection point.

Next, a flow path configuration inside the head unit 8 will be described. Ink supplied from the supply flow path C2 to the head unit 8 passes through a filter 83 and then is supplied to a first negative pressure control unit 81 and a second negative pressure control unit 82. The first negative pressure control unit 81 is set to have a control pressure of a low negative pressure. The second negative pressure control unit 82 is set to have a control pressure of a high negative pressure. Pressures in those first negative pressure control unit 81 and second negative pressure control unit 82 are generated within a proper range by the driving of the collection pump P2.

In an ink ejection unit 80, a printing element substrate 80*a* in which a plurality of ejection openings are arrayed is arranged in plural to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in an arranging direction of the printing element substrates 80*a*. Furthermore, in the individual printing element substrates 80*a*, individual supply flow paths connected to the common supply flow path 80*b* and individual collection flow paths connected to the common collection flow path 80*c* are formed. Accordingly, in each of the printing element substrates 80*a*, an ink flow is generated such that ink flows in from the common supply flow path 80*b* which has relatively lower negative pressure and flows out to the common collection flow path 80*c* which has relatively higher negative pressure. In the midstream of a path between the individual supply flow path and the individual collection flow path, a pressure chamber which is communicated with each ejection opening and which is filled with ink is provided. An ink flow is generated in the ejection opening and the pressure chamber even in a case where printing is not performed. Once the ejection operation is performed in the printing element substrate 80*a*, a part of ink moving from the common supply flow path 80*b* to the common collection flow path 80*c* is ejected from the ejection opening and is consumed. Meanwhile, ink not having been ejected moves toward the collection flow path C4 via the common collection flow path 80*c*.

Figure 6A:
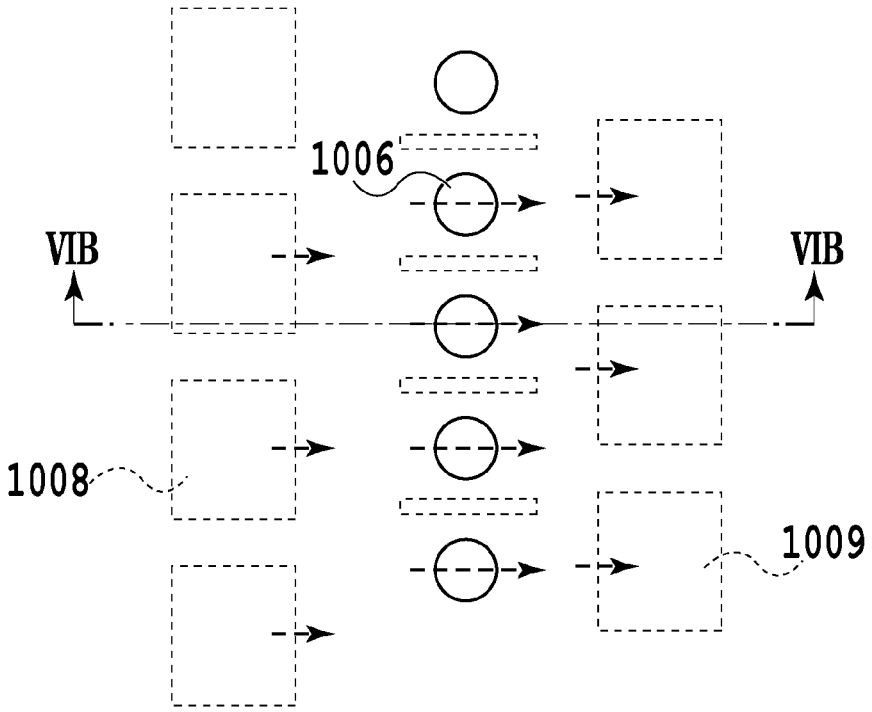
FIGS. 6A and 6B are diagrams illustrating an ejection opening and a pressure chamber.
Figure 6B:
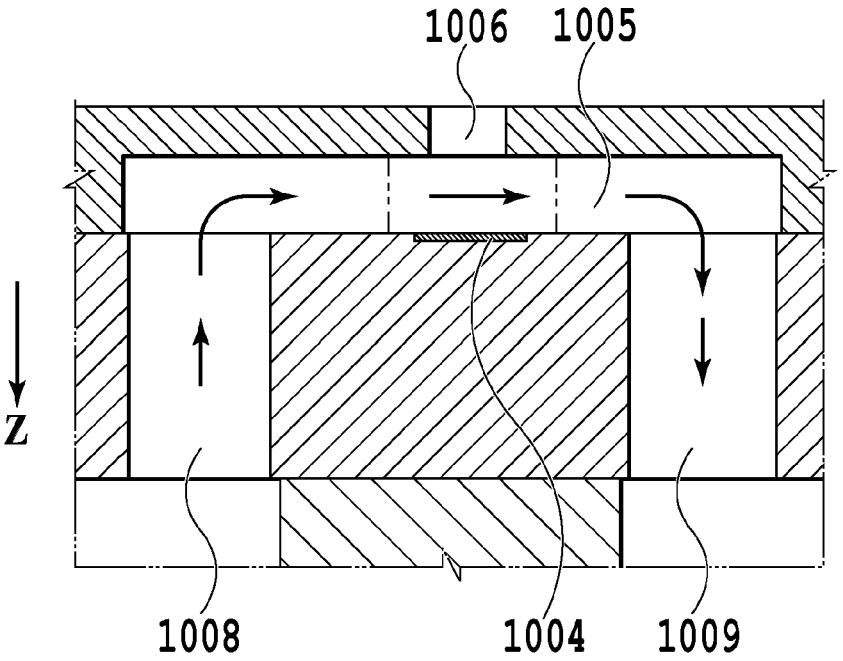

FIG. 6A is a plan schematic view enlarging a part of the printing element substrate 80*a*, and FIG. 6B is a sectional schematic view of a cross section taken from line VIB-VIB of FIG. 6A. In the printing element substrate 80*a*, a pressure chamber 1005 which is filled with ink and an ejection opening 1006 from which ink is ejected are provided. In the pressure chamber 1005, a printing element 1004 is provided at a position facing the ejection opening 1006. Further, in the printing element substrate 80*a*, a plurality of ejection openings 1006 are formed, each of which is connected to an individual supply flow path 1008 which is connected to the common supply flow path 80*b* and an individual collection flow path 1009 which is connected to the common collection flow path 80*c*.

According to the above configuration, in the printing element substrate 80*a*, an ink flow is generated such that ink flows in from the common supply flow path 80*b* which has relatively lower negative pressure (high pressure) and flows out to the common collection flow path 80*c* which has relatively higher negative pressure (low pressure). To be more specific, ink flows in the order of the common supply flow path 80*b*, the individual supply flow path 1008, the pressure chamber 1005, the individual collection flow path 1009, and the common collection flow path 80*c*. Once ink is ejected by the printing element 1004, part of ink moving from the common supply flow path 80*b* to the common collection flow path 80*c* is ejected from the ejection opening 1006 to be discharged outside the head unit 8. Meanwhile, ink not having been ejected from the ejection opening 1006 is collected and flows into the collection flow path C4 via the common collection flow path 80*c*.

Figure 7A:
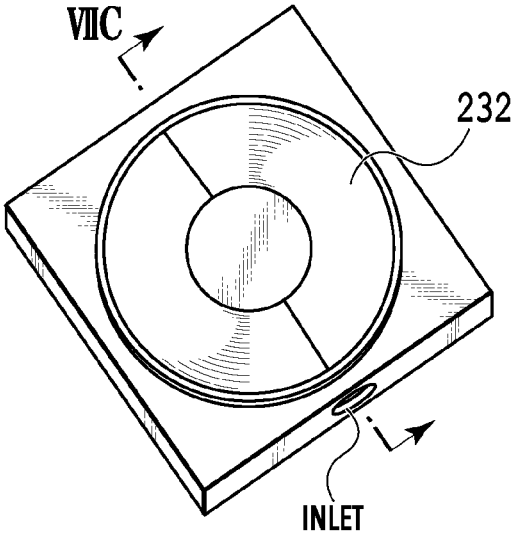
FIGS. 7A to 7C are diagrams illustrating a negative pressure control unit.
Figure 7B:
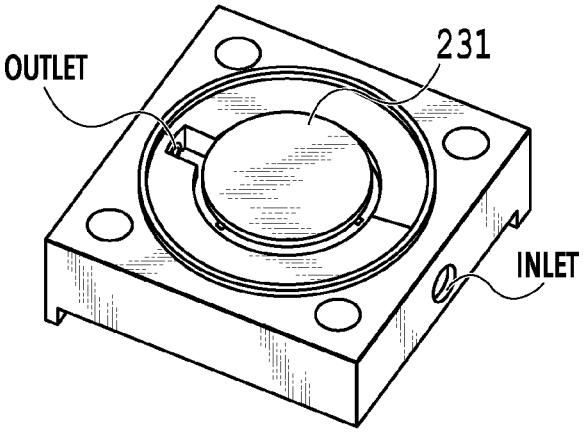
Figure 7C:
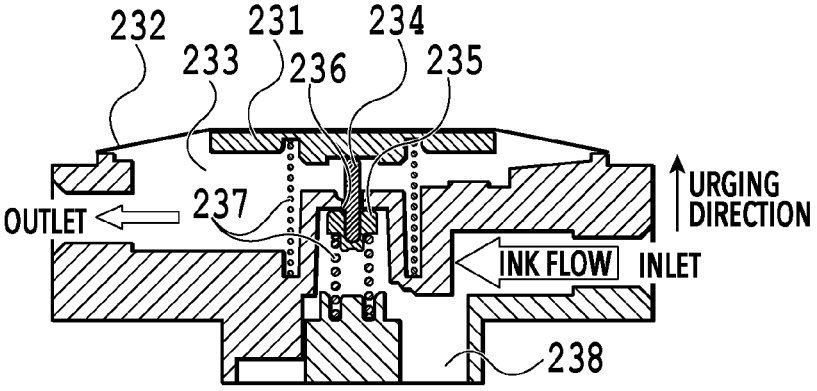

FIG. 7A to FIG. 7C show the first negative pressure control unit 81 provided in the head unit 8. FIG. 7A and FIG. 7B are appearance perspective views, and in particular, FIG. 7B shows inside the first negative pressure control unit 81 in the state where a flexible film 232 is not shown. FIG. 7C is a cross section taken from line VIIC-VIIC of FIG. 7A. The first negative pressure control unit 81 and the second negative pressure control unit 82 are differential pressure valves and have the same structure other than a difference in control pressures (the initial load of a spring), and therefore, a description on the second negative pressure control unit 82 will be omitted.

The first negative pressure control unit 81 is composed of the pressure receiving plate 231 shown in FIG. 7B and the flexible film 232 sealing an ambient air space so as to form a first pressure chamber 233 inside the first negative pressure control unit 81. The flexible film 232 is welded on an edge of a circular shape and on the pressure receiving plate 231 as shown in FIG. 7B. In accordance with the increase/decrease of ink inside the first pressure chamber 233, the flexible film 232 and the pressure receiving plate 231 on which the flexible film 232 is welded are displaced vertically.

In the upstream of the first pressure chamber 233 in an ink supplying direction, a second pressure chamber 238 connected to the supply pump P1, a shaft 234 coupled to the pressure receiving plate 231, a valve 235 coupled to the shaft 234, and an orifice 236 which abuts the valve 235 are provided. The orifice 236 of the present embodiment is provided at a boundary between the first pressure chamber 233 and the second pressure chamber 238. The valve 235, the shaft 234, and the pressure receiving plate 231 are further urged in the vertically upward direction by using an urging member (spring) 237.

In a case where an absolute value of a pressure inside the first pressure chamber 233 is equal to or more than a first threshold value (a case where a negative pressure is lower than the first threshold value), the valve 235 abuts the orifice 236 as a result of an urging force of the urging member 237 to interrupt the connection between the first pressure chamber 233 and the second pressure chamber 238. On the other hand, in a case where an absolute value of a pressure inside the first pressure chamber 233 is less than the first threshold value, that is, a negative pressure higher than the first threshold value is applied to the first pressure chamber 233, the flexible film 232 is contracted to be displaced downward. Accordingly, the pressure receiving plate 231 and the valve 235 are displaced downward against the urging force of the urging member 237, and the valve 235 and the orifice 236 are separated so that the first pressure chamber 233 and the second pressure chamber 238 are connected to each other. As a result of this connection, ink supplied by the supply pump P1 flows toward the first pressure chamber 233.

The first negative pressure control unit 81 has the configuration of the above-described differential pressure valve, and thus controls an inflow pressure and an outflow pressure to be constant. The second negative pressure control unit 82 uses the urging member 237 having a larger urging force than that of the first negative pressure control unit 81 so as to generate a higher negative pressure than that in the first negative pressure control unit 81. In other words, in the second negative pressure control unit 82, the valve is released in a case where an absolute value of the pressure of the unit becomes less than a second threshold, which is smaller than the first threshold value. Therefore, once the driving of the collection pump P2 starts, the first negative pressure control unit 81 is firstly released and then the second negative pressure control unit 82 is released.

Under the above configuration, in performing print operation, the ink supply control unit 209 closes the tank supply valve V1 and the head replacement valve V5 and opens the atmosphere release valve V0, the supply valve V2, and the collection valve V4 to drive the supply pump P1 and the collection pump P2. As a result, the circulation path in the order of the sub-tank 151, the supply flow path C2, the head unit 8, the collection flow path C4, and the sub-tank 151 is established. In a case where an amount of ink supply from the supply pump P1 per unit time is larger than the total value of an ejecting amount of the head unit 8 per unit time and a flow rate in the collection pump P2 per unit time, ink flows from the supply flow path C2 into the relief flow path C3. As a result, the flow rate of ink from the supply flow path C2 to the head unit 8 is adjusted.

In the case of not performing print operation, the ink supply control unit 209 stops the supply pump P1 and the collection pump P2 and closes the atmosphere release valve V0, the supply valve V2, and the collection valve V4. As a result, the ink flow inside the head unit 8 stops and the backflow caused by the water head difference between the sub-tank 151 and the head unit 8 is suppressed. Further, by closing the atmosphere release valve V0, ink leakage and ink evaporation from the sub-tank 151 are suppressed.

In the case of collecting ink from the head unit 8, the ink supply control unit 209 closes the atmosphere release valve V0, the tank supply valve V1, the supply valve V2, and the collection valve V4 and opens the head replacement valve V5 to drive the vacuum pump P0. As a result, the inside of the sub-tank 151 becomes in a negative pressure state, and ink inside the head unit 8 is collected to the sub-tank 151 via the head replacement flow path C5. As such, the head replacement valve V5 is a valve being closed during normal print operation or at the time of standby and being open upon collecting ink from the head unit 8. In addition, the head replacement valve V5 is released even at the time of filling the head replacement flow path C5 with ink for an ink filling to the head unit 8.

<Description of Deaeration>

Next, a deaeration process will be described. In the present embodiment, the ink supply control unit 209 stirs ink inside the sub-tank 151. The ink supply control unit 209 also drives the vacuum pump P0 to generate negative pressure inside the sub-tank 151. As a result, a process of removing gases dissolved in the ink inside the sub-tank 151 is performed. This deaeration process is performed at predetermined intervals.

The reason for performing the deaeration process will be described. The head unit 8 of the present embodiment is a so-called line head, and its amount of ejection tends to be large. The larger the amount of ejection of ink from the ejection opening surface 8*a*, the larger the amount of heat generated by the head unit 8. As the head unit 8 generates heat, the ink circulating through the head unit 8 is heated. As the ink is heated, gases dissolved in the ink appear in the form of bubbles. In a case where ejection openings are clogged with such bubbles, an ink ejection failure may occur. For this reason, it is necessary to minimize the gases dissolved in the ink. To do so, in the present embodiment, the deaeration process is performed inside the sub-tank 151. The deaerated ink is then circulated.

Here, in order to suppress re-dissolution of gases into the deaerated ink, it is preferable that the area of contact between the ink liquid surface and air be small. Thus, in the present embodiment, a floating body that floats on the ink liquid surface is provided inside the sub-tank 151 so that the area of contact between the ink liquid surface and air can be small.

<Description of Float>

Figure 8:
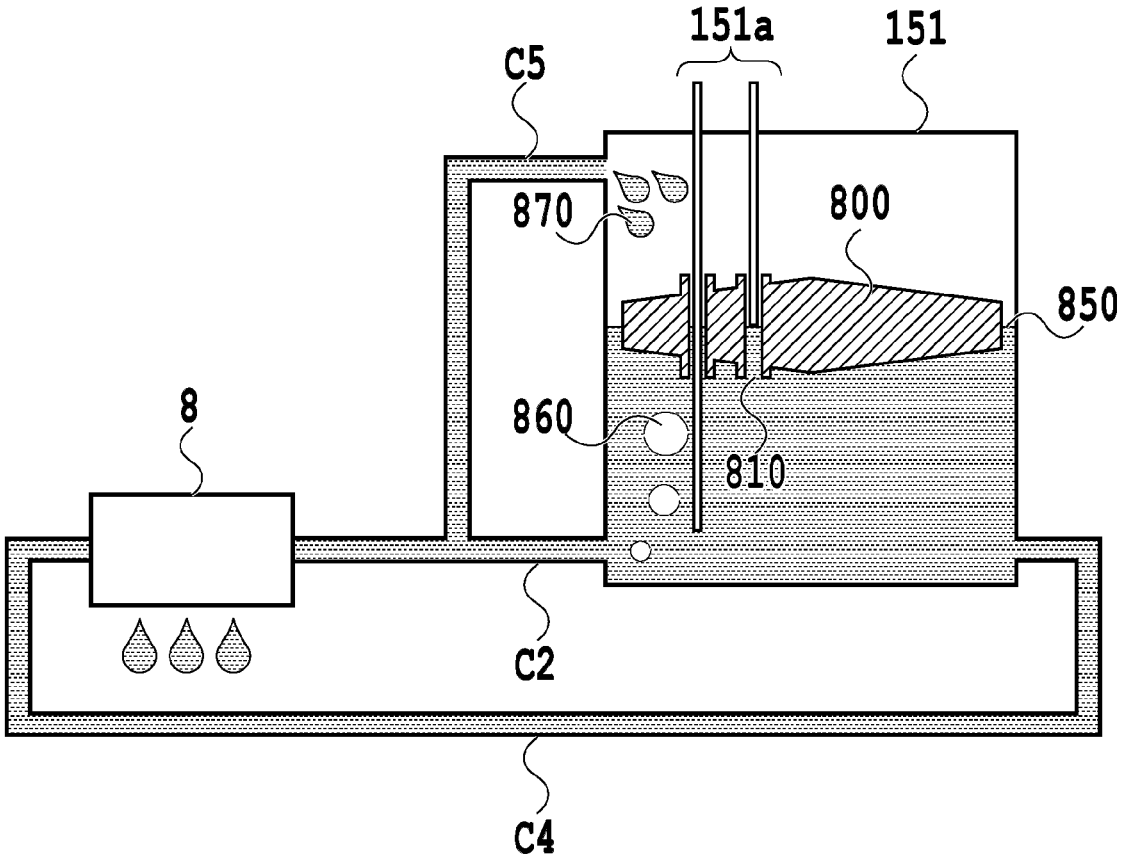
FIG. 8 is a diagram illustrating a configuration including a sub-tank.

FIG. 8 is a diagram schematically showing a configuration including the sub-tank 151 in the present embodiment. In the present embodiment, a float 800 is provided as a floating body that floats on the liquid surface of the ink inside the sub-tank 151. An upper portion of the sub-tank 151 is connected to the head replacement flow path C5, while a lower portion of the sub-tank 151 is connected to the supply flow path C2 and the collection flow path C4.

Figure 9A:
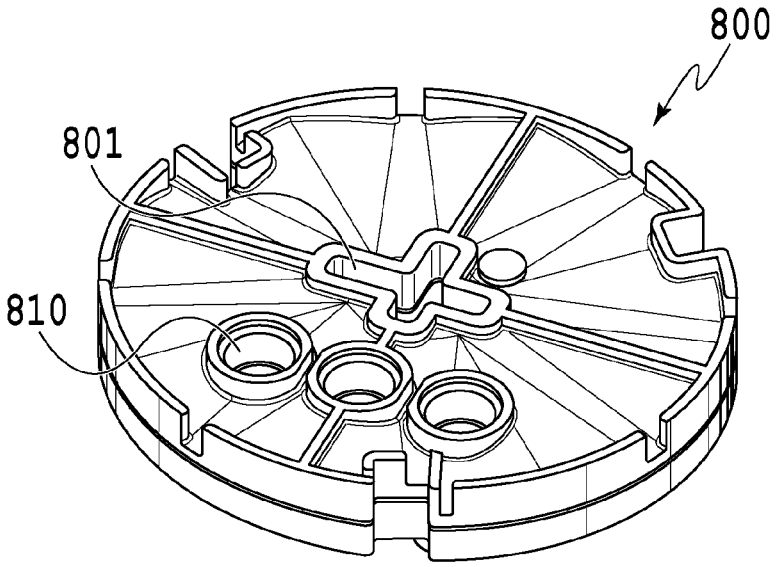
FIGS. 9A and 9B are views showing an example of the exterior of a float.
Figure 9B:
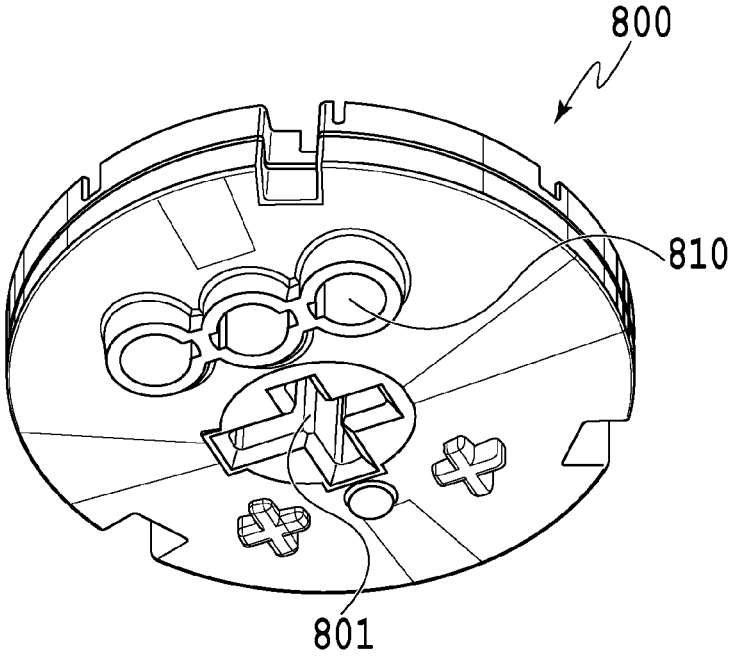

FIGS. 9A and 9B are diagrams illustrating an example of the exterior of the float 800. FIG. 9A is a perspective view of the float 800 as seen from its top surface side in the vertical direction (y-direction) while FIG. 9B is a perspective view of the float 800 as seen from its bottom surface side in the vertical direction (y-direction). The float 800 will be described below with reference to FIG. 8 and FIGS. 9A and 9B.

In the present embodiment, the float 800 is shaped to have a slope with respect to the horizontal direction. Specifically, the bottom surface side of the float 800, which contacts the ink, has a slope inclined toward the liquid surface, which is the interface between the ink and air. More specifically, the bottom surface side of the float 800 has such a slope that the thickness in the vertical direction decreases from the center toward the outer periphery.

With such a configuration, in a case where bubbles 860 enter the sub-tank 151 from its lower portion, those bubbles move toward a liquid surface 850 along the slope with their buoyancy. Also, in a case where gases dissolved in the ink appear in the form of bubbles 860 as a result of the generation of negative pressure or stir inside the tank and rise, those bubbles 860 likewise move toward the liquid surface 850 along the slope with their buoyancy. Thus, stagnation of bubbles on the bottom surface of the float 800 can be suppressed. As mentioned earlier, in order to suppress re-dissolution of air into the deaerated ink, it is preferable that the area of contact between the ink liquid surface and air be small. Stagnation of bubbles on the bottom surface of the float 800 increases the area of contact between the ink liquid surface and air and may thus possibly promote re-dissolution of gases into the ink.

Meanwhile, bubbles may appear inside the sub-tank 151 not only during deaeration but also during initial filling. For example, during initial filling, ink is filled into the circulation flow path with the sub-tank 151 already filled with ink. Thus, the air originally present in the circulation flow path may enter the sub-tank 151 and appear in the form of bubbles. Bubbles may also appear in ink due to vibration, temperature change, and so on. Even in such cases, stagnation of bubbles 860 on the bottom surface of the float 800 can be suppressed since the bottom surface side of the float 800, which contacts the ink, has a slope inclined toward the liquid surface 850, which is the interface between the ink and air.

Further, the top surface side of the float 800, which contacts air, has a slope inclined toward the liquid surface 850, which is the interface between the ink and the air. More specifically, the top surface side of the float 800, which contacts air, has such a slope that the thickness in the vertical direction decreases from the center toward the outer periphery. With such a configuration, it is possible to suppress stagnation of ink droplets 870 that have attached to the electrode pins 151*a*, which detect the level of the liquid surface.

As shown in FIG. 8 and FIGS. 9A and 9B, opening portions 810 are formed in the float 800, and the electrode pins 151*a* are inserted in the opening portions 810. The electrode pins 151*a* are inserted in the opening portions 810 so as not to contact the float 800. With the electrode pins 151*a* in contact with the liquid, a closed circuit is formed through the liquid, and the liquid surface is detected by means of conduction of an electric current in this closed circuit.

Here, in a case where ink is collected through the head replacement flow path C5, droplets 870 from the upper portion of the sub-tank 151 attach to the top surface of the float 800. Also, ink droplets 870 inside the sub-tank 151 may attach to the top surface of the float 800 due to vibration or the like. In these cases, if the attached ink droplets stagnate in the vicinity of the electrode pins 151*a*, the electrode pins 151*a* may be short-circuited, thereby lowering the accuracy of the liquid surface detection. In the present embodiment, the top surface side of the float 800, which contacts air, has a slope inclined toward the liquid surface 850, which is the interface between the ink and the air. Thus, ink droplets that have attached to the top surface of the float 800 flow down toward the liquid surface 850. Hence, the ink droplets do not stagnate in the vicinity of the electrode pins 151*a*, and deterioration of the detection accuracy of the electrode pins 151*a* can thus be suppressed.

Also, as shown in FIG. 8 and FIG. 9B, the height of each opening portion 810 of the float 800 on the bottom surface side is greater than the height of a portion around the opening portion 810. In other words, the bottom surface side of each opening portion 810 of the float 800 is shaped to have a protrusion protruding from the bottom surface side. With such a configuration, in a case where bubbles 860 appearing in the ink reach the protrusions of the opening portions 810 on the bottom surface side, they move around the protrusions and continue rising further. Hence, the bubbles appearing in the ink do not stagnate in the vicinity of the electrode pins 151*a*, and deterioration of the detection accuracy of the electrode pins 151*a* can thus be suppressed.

Also, as shown in FIG. 8 and FIG. 9A, the height of each opening portion 810 of the float 800 on the top surface side is greater than the height of a portion around the opening portion 810. In other words, the top surface side of each opening portion 810 of the float 800 is shaped to have a protrusion protruding from the top surface side. With such a configuration, in a case where ink droplets 870 reach the protrusions of the opening portions 810 on the top surface side, they move around the protrusions and flow down to the periphery. Hence, the ink droplets 870 having attached to the top surface of the float 800 do not stagnate in the vicinity of the electrode pins 151*a*, and deterioration of the detection accuracy of the electrode pins 151*a* can thus be suppressed.

Figure 10A:
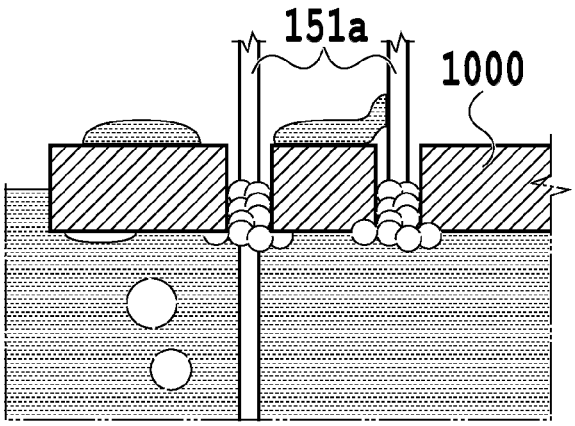
FIGS. 10A and 10B are diagrams illustrating an advantageous effect.
Figure 10B:
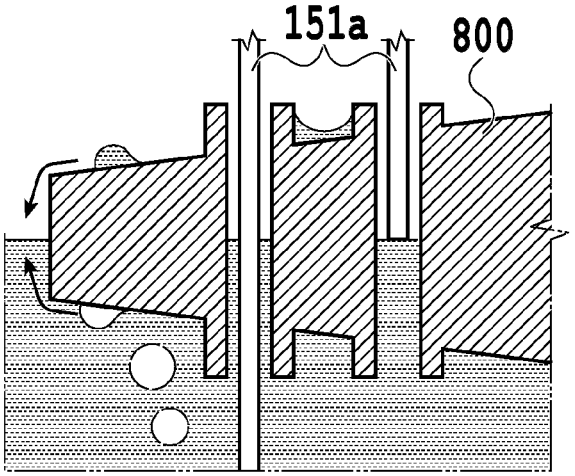

FIGS. 10A and 10B are diagrams illustrating an advantageous effect of the present embodiment. FIG. 10A shows a float 1000, as a comparative example, that has no slope and has the same height at its opening portions and the portions around them. FIG. 10B shows the float 800 according to the present embodiment. They both show enlarged views of the vicinity of the opening portions of the floats.

As shown in FIG. 10A, the float 1000 has no slope on its bottom surface side. In this case, bubbles appearing in the ink stagnate on the bottom surface side of the float 1000. This increases the area of contact between the ink liquid surface and air and thus promotes re-dissolution of gases into the ink. Moreover, as shown in FIG. 10A, the height of each opening portion of the float 1000 on the bottom surface side is equal to the height of the portion around the opening portion. In this case, bubbles may stagnate in the vicinity of the electrode pins 151*a* and deteriorate the detection accuracy of the electrode pins 151*a*. Further, as shown in FIG. 10A, the float 1000 has no slope on its top surface side. In this case, ink that has attached to the top surface of the float 1000 stagnates on the top surface. Such ink may attach to and stagnate on the electrode pins 151*a* due to vibration or the like and deteriorate the detection accuracy of the electrode pins 151*a*. Furthermore, as shown in FIG. 10A, the height of each opening portion of the float 1000 on the top surface side is equal to the height of the portion around the opening portion. In this case, ink having attached to the top surface of the float 1000 may attach to and stagnate on the electrode pins 151*a* and deteriorate the detection accuracy of the electrode pins 151*a*.

In contrast, in the present embodiment, as shown in FIG. 10B, the bottom surface side of the float 800, which contacts the ink, has a slope inclined toward the liquid surface, which is the interface between the ink and air. Also, the top surface side, which contacts the air, has a slope inclined toward the liquid surface, which is the interface between the ink and the air. Further, the height of each opening portion 810 of the float 800 on the bottom surface side is greater than the height of the portion around the opening portion 810. In other words, a perimeter of the opening portion 810 protrudes from a bottom surface side of the floating body. Furthermore, the height of each opening portion 810 of the float 800 on the top surface side is greater than the height of the portion around the opening portion 810. In other words, a perimeter of the opening portion 810 protrudes from a top surface side of the floating body. With such a configuration, it is possible to suppress increase in the area of contact between the ink liquid surface and the air and thus suppress re-dissolution of gases into the ink. It is also possible to suppress deterioration of the detection accuracy of the electrode pins 151*a*.

Figure 11:
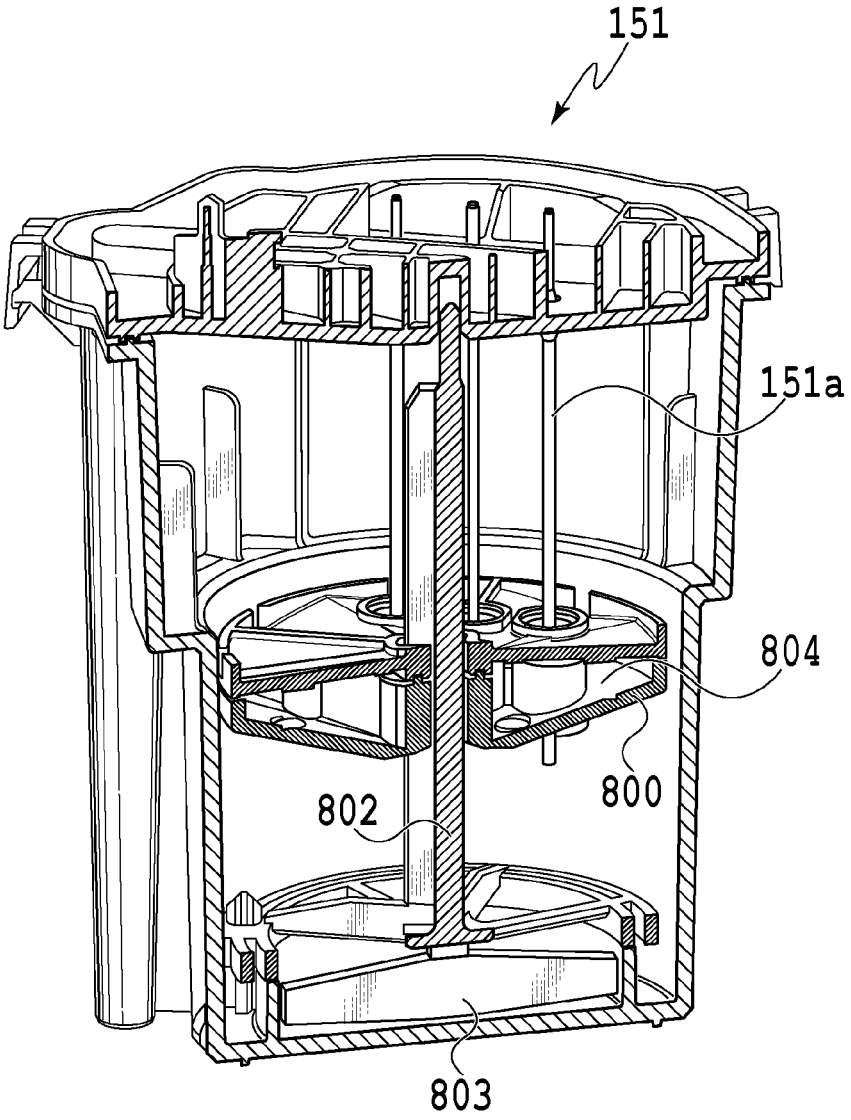
FIG. 11 is a cross-sectional perspective view of the sub-tank.

FIG. 11 is a cross-sectional perspective view illustrating the inside of the sub-tank 151. The float 800 is in a circular shape corresponding to the shape of the sub-tank 151 and, as shown in FIG. 9, a crisscross opening 801 of a substantially crisscross shape is formed in the center. The opening portions 810, in which to insert the electrode pins 151*a*, are also portions where air and the liquid surface contact each other. Thus, the opening portions 810 are preferably as small as possible. However, if the opening portions 810 are small, there is a possibility that the electrode pins 151*a* contact the float 800 in a case where the float 800, floating on the liquid surface, moves due to displacement of the liquid surface. To solve this, this crisscross opening 801 and a guide mechanism 802 are configured to restrict movement of the float 800 due to the liquid surface displacement and the like.

The guide mechanism 802 is shaped so as to be fitted in the crisscross opening 801. The guide mechanism 802 extends in the direction of gravity inside the sub-tank 151. The guide mechanism 802 is also a mechanism that holds a stirrer 803. The stirrer 803 is provided at the bottom of the sub-tank 151 and stirs the ink inside the sub-tank 151 by rotating with external magnetic force, for example.

As shown in FIG. 11, inside 804 of the float 800 is an empty space. For example, the float 800 can be made of a resin material that is a material with a smaller relative density than that of the ink. Here, in a case where stir is performed with the stirrer 803 to deaerate the ink inside the sub-tank 151, the float 800 may be drawn into the ink. To prevent this, the inside 804 is formed into an empty space to generate buoyancy so that the float 800 will not be drawn into the ink.

<Modification>

Figure 12:
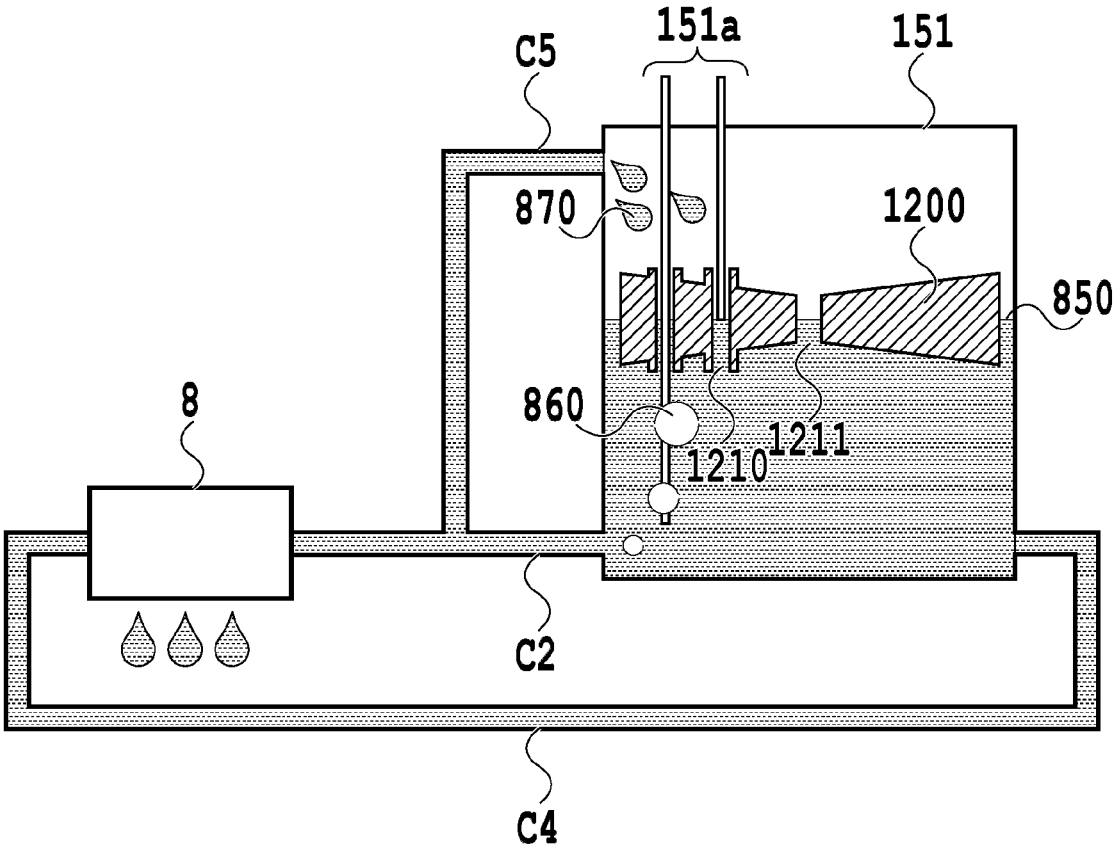
FIG. 12 is a diagram illustrating a configuration including a sub-tank.

FIG. 12 is a diagram showing a modification. A float 1200, on its bottom surface side, which contacts the ink, has a slope inclined toward the liquid surface, which is the interface between the ink and air. More specifically, the bottom surface side of the float 1200 has such a slope that the thickness in the vertical direction decreases from the outer periphery toward the center. Also, an opening portion 1211 is formed in the center. The opening portion 1211 may be the same opening as the crisscross opening 801. Also, the top surface side of the float 1200, which contacts the air, has a slope inclined toward the liquid surface 850, which is the interface between the ink and the air. More specifically, the top surface side of the float 1200, which contacts the air, has such a slope that the thickness in the vertical direction decreases from the outer periphery toward the center. As described above, each slope on the float may just need to be formed inclined toward the liquid surface 850, which is the interface between the ink and the air.

According to the present disclosure, even in a case where bubbles appear inside a tank, it is possible to suppress increase in the area of contact between ink and air.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-030844, filed Feb. 23, 2018, which is hereby incorporated by reference wherein in its entirety.

What is claimed is:

1. An inkjet printing apparatus comprising:

a print head that ejects ink;

a tank that contains ink to be supplied to the print head;

a floating body that floats on a liquid surface of the ink inside the tank; and an electrode pin that detects a level of the liquid surface inside the tank, wherein the floating body includes an opening portion in which to insert the electrode pin, and a perimeter of the opening portion protrudes from a top surface side of the floating body.

2. The inkjet printing apparatus according to claim 1, wherein the top surface side of the floating body has a slope inclined toward the liquid surface, which is an interface between the ink and the air.

3. The inkjet printing apparatus according to claim 1, wherein a bottom surface side of the floating body has a slope inclined toward the liquid surface, which is an interface between the ink and the air.

4. The inkjet printing apparatus according to claim 1, wherein the tank stores deaerated ink.

5. The inkjet printing apparatus according to claim 1, further comprising a restricting unit that restricts movement of the floating body.

6. The inkjet printing apparatus according to claim 5, wherein the restricting unit comprises a guide mechanism extending in a direction of gravity inside the tank, the floating body includes an opening portion designed to be fitted to the guide mechanism, and the guide mechanism restricts movement of the floating body by being fitted to the opening portion.

7. The inkjet printing apparatus according to claim 1, further comprising a stirrer that stirs the ink inside the tank.

8. The inkjet printing apparatus according to claim 1, wherein inside of the floating body is an empty space.

9. The inkjet printing apparatus according to claim 1, further comprising an intra-tank vacuum pump that reduces pressure inside the tank.

10. The inkjet printing apparatus according to claim 9, wherein the print head includes an ejection opening surface in which ejection openings configured to eject ink are arrayed, and pressure chambers which communicate with the ejection openings and are filled with ink, and ink is circulated so as to flow through inside of the pressure chambers.

11. The inkjet printing apparatus according to claim 10, further comprising:

a supply flow path through which to supply ink from the tank to the print head; and a collection flow path through which to collect ink from the print head to the tank, wherein ink is circulated so as to flow through the supply flow path, the inside of the pressure chambers, and the collection flow path.

12. The inkjet printing apparatus according to claim 11, wherein the supply flow path and the collection flow path are connected to a lower portion of the tank.

13. The inkjet printing apparatus according to claim 11, further comprising a replacement flow path through which an upper portion of the tank and the supply flow path communicate with each other, wherein ink filled in the print head is collected into the tank through the replacement flow path by stopping the ink circulation and reducing the pressure inside the tank with the intra-tank vacuum pump.

14. The inkjet printing apparatus according to claim 1, wherein a perimeter of the opening portion protrudes from a bottom surface side of the floating body.

15. A tank that contains ink to be supplied to a print head ejecting ink comprising:

a floating body that floats on a liquid surface of the ink inside the tank; and an electrode pin that detects a level of the liquid surface inside the tank, wherein the floating body includes an opening portion in which to insert the electrode pin, and a perimeter of the opening portion protrudes from a top surface side of the floating body.

16. The tank according to claim 15, wherein the top surface side of the floating body has a slope inclined toward the liquid surface, which is an interface between the ink and the air.

17. The tank according to claim 15, wherein a bottom surface side of the floating body has a slope inclined toward the liquid surface, which is an interface between the ink and the air.

18. The tank according to claim 15, wherein the tank stores deaerated ink.

19. The tank according to claim 15, further comprising a restricting unit that restricts movement of the floating body.

20. The tank according to claim 19, wherein the restricting unit comprises a guide mechanism extending in a direction of gravity inside the tank, the floating body includes an opening portion designed to be fitted to the guide mechanism, and the guide mechanism restricts movement of the floating body by being fitted to the opening portion.

* * * * *